United States Patent [19]

Keith

[11] 4,025,601

[45] May 24, 1977

[54] PROCESS OF DRAWING A SHAPED PLASTIC SHEET HAVING HOLLOW POINTED PROJECTIONS

[75] Inventor: Donald George Keith, Mount Eliza, Australia

[73] Assignee: ICI Australia Limited, Australia

[22] Filed: May 13, 1974

[21] Appl. No.: 469,662

[30] Foreign Application Priority Data

May 29, 1973 Australia ..... 3474/73

[52] U.S. Cl. ..... 264/291; 264/154; 264/288; 264/DIG. 47

[51] Int. Cl.[2] ..... B29C 17/02

[58] Field of Search ..... 264/284, 288, 289, 291, 264/293, DIG. 47, 147, 154; 28/DIG. 1

[56] References Cited

UNITED STATES PATENTS

| | | | |
|---|---|---|---|
| 3,441,638 | 4/1969 | Patchell et al. | 264/289 |
| 3,470,595 | 10/1969 | Goppel | 264/DIG. 47 |
| 3,484,835 | 12/1969 | Trounstine et al. | 264/284 |
| 3,574,809 | 4/1971 | Fairbanks et al. | 264/289 |
| 3,682,760 | 8/1972 | Fairbanks | 264/289 |

FOREIGN PATENTS OR APPLICATIONS

| | | |
|---|---|---|
| 792,077 | 11/1972 | Belgium |

*Primary Examiner*—James B. Lowe
*Attorney, Agent, or Firm*—Cushman, Darby & Cushman

[57] ABSTRACT

A process of cold drawing a shaped plastic sheet wherein said sheet has an array of substantially parallel rows of hollow pointed projections on one or both faces; said projections having at least a portion of the distal portion of the sides at an angle of over 60° to the median plane of the sheet which process comprises cold drawing the shaped plastic sheet along an axis in the plane of the sheet normal to the rows of hollow projections.

7 Claims, No Drawings

PROCESS OF DRAWING A SHAPED PLASTIC SHEET HAVING HOLLOW POINTED PROJECTIONS

This invention relates to the orientation of plastic sheet by cold drawing and to products made thereby.

The production of film fibres is well known in the art and comprises the cold drawing of a suitable plastic film so that the film becomes highly orientated along the direction of stretch and finally fibrillates into tapes or fibres. The art is well described in the "Textiles from Film" Plastics Institute of Great Britain Conference July 1971 (two volumes).

For many textile purposes it is found desirable to bulk such fibre by forming and setting into the fibre a systematic and large deviation from straightness. In one dimensional systems such as slender fibres bulking is some form of crimping, coiling, or looping; i.e. geometric forms which like springs tend to straighten under tension.

Film fibre is bulked by various means such as passing through meshed gears or a steam stuffing box. All such known processes of bulking film fibre, bulk the fibre after cold drawing and have the disadvantage that the fibres lose bulk under tension by unfolding or straightening of the distorted fibres.

We have discovered a process of cold drawing a shaped plastic sheet to give bulked film fibre products which do not lose bulkiness under tension.

Accordingly we provide a process of cold drawing a shaped plastic sheet wherein said sheet has an array of substantially parallel rows of hollow pointed projections on one or both faces; said hollow pointed projections having at least a portion of the distal portion of their sides at an angle of over 60° to the median plane of the sheet which process comprises cold drawing the shaped plastic sheet along an axis in the plane of the sheet substantially normal to the rows of hollow projections.

By pointed we mean a projection of which the surface area of the tip is small compared with the surface area of the base of the projection. Thus the tip of the projection may be, for example, sharply pointed, rounded or may even end in a small flat area. In certain cases as described in Example 8 points may be further shaped prior to drawing.

On cold drawing a shaped plastic sheet as defined herein above the material lying in the median plane of the sheet together with any adjacent parts of the sheet inclined at a small angle to the plane of the sheet is drawn but the material lying in the portion of the projection having sides at an angle of over 60° to the median plane resists cold drawing and the ends of the projections remain and form barbs in the tape fibre.

The exact shape of the hollow pointed projections is not critical to the invention as a barbed fibre will always be obtained, however the fibre obtained will have different properties depending upon the precise shape of the projections. Preferably the slope of the proximal portion of the side of the projections is at a smaller angle to the median plane of the sheet than the distal portion. Conveniently, the hollow pointed projections are in the shape of cusps. By cusps we mean irregular hollow cones having concave sides. The projections may either be isolated one from the other or more usually the shaped sheet consists of a series of interconnecting cusps with little or no intervening unshaped areas.

The behaviour of the shaped sheet in cold draw is found to depend sensitively on the slope of the cusps. Relatively shallow cusps with typical average slope of 30° or less are almost fully resorbed by cold draw of six fold or more, and only a faint waviness can be detected in the oriented film. At slopes around 45° cold draw tends to pull the slope down to 10° to 15°. Steep slopes, 60° to 85° are scarcely resorbed at all. These factors vary with temperature, cusp resorption being greater at a warmer "cold" draw temperature than at the lower cold draw conditions.

The dimensions and shape of the cusped filaments obtained by our process are controlled by the shape, wall thickness and frequency of projections and by the temperature and extent of cold drawing. For all cases that part of the cusp which is intended to survive cold draw must have an angle to the original film plane of more than 60° preferably more than 70° while the base of the cusp should have an angle of less than 60°. Cusps will normally be present on the shaped plastic sheet in some regular design such as a square lattice, and cusps may either point upwards and downwards (not necessarily in equal numbers) or all point one way. Further the cusp axes need not necessarily be perpendicular to the sheet plane but may be inclined. (If the cusp is inclined the distal portion of the side of the cusp should be less than 30° to the axis of the cusp.)

The precursor unit filament is a strip of shaped sheet as wide as the cusp and of the thickness from which the cusp is drawn. The base width of the cusp is taken to be the width of the circular base of the cone which envelopes the cusp. Since in practice the width of cusp must be more than twice the thickness of material required to form the cusp, and may be in much higher ratio, the unit filament precursor is a tape whose thickness and width typically lie in the range of 1:2 to 1:10.

Prior to cold drawing the shaped plastic sheet may be shred into its unit strips, or the entire sheet may be drawn in one piece leaving open the option of ultimate shredding or fibrillation. The amount of draw required for shredding or fibrillation is obvious to those skilled in the art of film fibre manufacture. When the shaped plastic sheet is drawn the yield first of all takes place either at the flat cusp flanks or in the unworked film between cusps, and draw is continued until molecular orientation has reached the required stage of completeness; but it is found even in highly drawn material that draw cannot invade the high-angle regions of cusps. This is mainly because such material is substantially at right angles to the direction of tension, and in effect a ring or loop of oriented material forms round the cusp base which prevents tension from reaching the high angle cusp. When draw occurs the mechanical effect of the cusp is to act as a heavily flanged hole in the tape.

Since the shaped sheet is normally drawn down '$m$' fold where '$m$' commonly is in the range 4 to 16, the sheet will be correspondingly reduced in cross sectional area, causing width and breadth reductions in the range $\sqrt{4}$ to $\sqrt{16}$. If in the shaped sheet the tips of the cusps are heavily walled and the cusp flanks are light walled drawing will either cause fracture or lead to drawn filament of very light structure with relatively massive cusps. To plan for a more structurally efficient filament the cusps should preferably be thin walled near the tip, heavier at the low slope cusp flanks near the base of the cusp and the distal portion of the cusps should have sides substantially normal to the plane of the sheet. It is desirable to produce a drawn cuspated fibre with a controlled cusp/fibre weight ratio. By producing light steep cusps it is easy to produce cusp fibre ratios of 10% or less. The cusp frequency in fully drawn fibres in also subject to limits. Since the drawn fibre at least in part normally originates from cusp flanks, and if it is to be elongated '*m*' fold we find that, for structurally well balanced cusped filaments, cusps can be situated at a minimum distance apart of about 2 pm where '*p*' is the distance between cusp tips in the undrawn sheet, and '*m*' is the draw factor.

The plastic sheet used in our process may be shaped by any conventional method known in the art. A particularly useful process of shaping is described in Belgian Patent No. 792,077.

In this process the plastic is melt spinnable and the shaped sheet is made by a process comprising deforming a sheet of the thermoplastic material by pressing against one face of the hot sheet of material an arrary of cold projections, and simultaneously pressing against the second face of the sheet of the material a second array of cold projections so that the arrays interpenetrate in such a manner that the projections on the second array are spaced from the projections on the first array by a distance greater than the thickness of the sheet.

Suitable melt spinnable plastics are, for example, low density polyethylene, high density polyethylene, polyethylene terephthalate, nylon 6, nylon 66, nylon 610, polypropylene.

The process described in Belgian Patent No. 792,077 is capable of producing plastic sheets having cusps on one or both faces and having cusps of a suitable wall thickness. The exact conditions required to obtain shaped sheets having cusps having the required near vertical sides may be found by simple experiment as shown in Example 4.

Shaped sheets may also be formed by a modification of the process of Belgian Patent No. 792,077 in which one array of projections is an array of needles and the other array of projections is an array of tubes into the center of which tubes the needles interdigitate thus forming the cusps. The shaped sheets may also bemade by the conventional process of vacuum forming in which a sheet of deformed plastic is pushed against an array of projections by differential fluid pressure or by the conventional moulding processes in which a molten layer of plastic is cast directly onto the needle array.

In the art of film fibre manufacture it is known to engrave, flute, emboss or notch the precursor film with the main purposes either of assisting fibrillation into regular strands or of creating fibrils of other than rectangular cross section. These arts using relatively shallow solid embossment are entirely distinct from our discovery which employs very deep drawn hollow projections. In the pre-embossed art all the material becomes drawn: in contrast to our method in which the cusps remain undrawn.

The product made by our process has not hitherto been prepared by other methods. Accordingly we also provide a fibrillated or unfibrillated cold drawn plastic sheet prepared by a process of our invention described hereinabove. The extent of cold drawing may be varied. The sheet may be cold drawn until fibrillation occurs or the sheet may be merely drawn until orientated but not sufficient for fibrillation. The drawn sheet in each case comprises a tape of oriented material which is toothed by projections which remain incompletely drawn.

This tape and film fibres made from it do not lose bulkiness under tension and, hence, have many applications not open to fibres prepared by film fibre processes known in the art.

The tapes or fibres so produced have cusps or projections which provide for slip resistance in use. Fibres so made produce yarns or bundles with a high natural bulk and staple yarns resist failure in tension due to slippage between fibres. As reinforcements for plastics foams, portland cement, plaster, thermosetting resins, low melting alloys, these tapes, fibres, and yarns or fabrics wholly or partly based on them bond by embodiment of the cuspated fibres regardless or chemical adhesion. In particular the tapes or fibres of our invention offer especial merit for composite systems where physical entanglements result from interaction of the parts. For example in resin bonded granular constructs such as particle board or resin bonded stone chip the average space between filler particles may represent fibre diameter so that the cusp is mechanically trapped. Likewise such fibres as a minor component of particulate systems will alter slump characteristics and angle of repose. Hence such fibres will fortify rammed clay, earth and like systems and stabilise them against erosion.

Likewise such fibres or tapes will strongly hinge adjacently cast components. Such fibres will serve as noded supports for goods or objects so hung as to hook on to the nodes.

A further unexpected feature of the cold drawn sheet of the present invention is that the projections act as fibrillation stoppers and therefore the process may be carried out to give a sheet of fibres or tapes joined together at the projections. This type of sheet has the properties of a yarn but has the advantage of being cheap and easy to manufacture.

This invention is now illustrated by, but by no means limited to, the following examples.

EXAMPLE 1

This example not of our invention illustrates the preparation of formed plastic sheet suitable for the cold drawing process.

Two square arrays of sharp needles were mounted on a ligh handpress capable of bringing the parts together in register. The upper and lower arrays were offset so that any needle of the upper set would enter the centre of a square of four of the needles of the lower set; in effect the arrays were staggered to give uniform interdigitation.

The "unit square" distance in each array was ½ inch and the free needle height 1 inch. Polyethylene film specimens, clamped in an open frame comprising hinged square annuli were fused to thermoforming temperature by being held in proximity with a radiant hotplate, and quickly placed between the jaws of the press.

The arrays at ambient temperature were allowed to interdigitate under low pressure. Countercuspate shapings were produced. It was found that polyethylene film ranging from thicknesses of 0.006 to 0.100 inch could be drawn to depths of 1 inch, giving increases in surface area up to 900%. The rate of draw giving best results required 1 to 2 seconds for a "mould" interpenetration of 1 inch. Under those conditions the resulting cuspated sheet specimens if carefully sectioned showed that maximum stretch had occurred in the mid region while the tips of the cusps remained relatively unthinned. Similar results were obtained using sheets of polypropylene.

EXAMPLE 2

The experiments of Example 1 were repeated using arrays of fine needles only 0.08 inch apart and 0.4 inch high and fine structured cuspated sheet with a texture resembling coarse velvet was obtained.

EXAMPLE 3

The cuspated sheets prepared by the method of Example 1 and Example 2 were produced in polypropylene of various thicknesses. These sheets were oven-heated to temperatures in the range 120° to 170° C and drawn up to tenfold increase in length at rates ranging from 3 to 100 ft/min.

EXAMPLE 4

This example illustrates the preparation of shaped plastic sheet suitable for the cold drawing process. The cusp forming device was made up by locating two identical planar arrays of sharp needles in a handpress, the upper and lower arrays being offset so that any needle of the upper set would enter the centre of a square of four of the needles of the lower set; in effect the arrays were staggered to give uniform interdigitation. The needle pattern in each array was a square lattice with one axis parallel to the draw direction of unit side 0.100 inch spacing the sharp needles being 0.028 inch diameter and 0.600 inch long.

Polypropylene film specimens 0.024 inch thick, clamped in an open frame comprising hinged square annuli were fused to thermoforming temperature by being held in proximity to a radiant hotplate and quickly placed between the jaws of the press which was set to interpenetrate the needle arrays by 0.240 inch. Over a wide range of conditions cusped sheet was made with grossly different materials distribution ranging from product in which the needles had caused perforation to product in which the cusps were so heavy that very little material was left at the neutral axis for cold drawing. We found that by elevating needle temperature in a prewarming oven, so that needles were initially from 20° to 40° C below the hardening point of the plastic the most decisive means of controlling cusp weight and materials distribution was obtained. The range of draw was also of importance; good results being obtained by closing the mould at a rate about 2 inches per second.

Under conditions close to these optima concave sided, substantially vertically tipped cusps were obtained, the original gauge of plastic being reduced by 50% on cusp flanks. The shaped sheet slit into strips between rows of cusps and subsequently cold drawn at 120° C to produce filaments of about 90 Tex with firm cusps at intervals of about 0.600 inch after a 12 fold draw. Such filaments under tension were found to fail at no preferred locus relative to the nodes. The results at the optimisation experiments are shown in the following Table.

| | Conditions of manufacturing shaped sheet (in each case depth of draw was 0.300 in) | | | | Conditions of cold draw (in each case sheet was drawn 8 fold | | |
|---|---|---|---|---|---|---|---|
| Expt No | Needle temp. | Rate of draw inches/sec | Temp of sheet ° C | Remarks | Temp of sheet ° C | Post draw treatment | Remarks |
| 1 | 25 | 20 | 220 | Perforated rate of draw too high | — | — | Shaped sheet unsuitable due to piercing of sheet |
| 2 | 50 | 20 | 220 | | — | — | |
| 3 | 75 | 20 | 220 | | — | — | |
| 4 | 25 | 10 | 220 | Cusp tip solid cusp walls too flimsy no material in cusp flanks | 120 | None | barbed tapes produced but barbs very weak |
| 5 | 50 | 10 | 220 | | 120 | None | |
| 6 | 75 | 10 | 220 | | 120 | None | |
| 7 | 25 | 5 | 220 | Cusp too blobby | 120 | None | barbed tape with medium strength barbs |
| 8 | 50 | 5 | 220 | Better but still thin walled | 120 | None | |
| 9 | 75 | 5 | 220 | Acceptable | 120 | None | |
| 10 | 25 | 2 | 220 | Too cusp heavy | 120 | None | unworkable |
| 11 | 50 | 2 | 220 | Improved | 120 | None | fibre failed between cusps |
| 12 | 75 | 2 | 220 | Good | 120 | None | Better fibre strength more uniform |
| 13 | 50 | 1.5 | 180 | good | 120 | Fibrillated after draw in each case | Fibres with strong barbs in each case |
| 14 | 75 | 1.5 | 180 | better | 120 | | |
| 15 | 90 | 1.5 | 180 | excellent | 120 | | |

EXAMPLE 5

A vented square lattice design placed at 45° to the intended draw direction was equipped with sharply tapered stainless steel needles of 0.048 inch diameter and was set up on a vacuum forming machine, the unit square being 0.200 inch and the needles being 0.030 inch long. Partly drawn polyethylene terephthalate sheet 0.030 inch thick was preheated to thermoforming temperature and clamped quickly over the vacuum mould and pressure reduced over a period of ½ second. The one-sided cusped sheet so produced was reheated and drawn 5 fold to orient the material. Similar specimens drawn 10 fold were produced in polypropylene.

EXAMPLE 6

Polypropylene cold drawn cusped film produced as in examples 3 to 5 was subjected to moderate flexing and crumpling to enhance its natural tendency to fibrillate. It was found that cusps act as fibrillation stoppers, but cleavage along cusp rows occurred especially readily. When the cusp design was oblique to the drawn axis as in Example 5 fibrillation tended to produce a net like structure.

EXAMPLE 7

Polyethylene terephthalate film produced by blow extrusion and already partially biaxially oriented was used as a basis for trials, the sheet being 0.060 inch thick and the shaped plastic sheet was prepared by the general method of Example 4 in which the cusping mould was a square lattice design at unit square of 0.200 inch. The needles were chenille sewing needles 1.500 inch long, such needles being very sharp and slender. Our intention was to investigate the effect of extremely deep and vertical draw; polyethylene terephthalate being especially suitable for such use. We produced cusps of aspect ratios as high as 8, that is the hollow protruberances were eight times as deep as their base width.

By careful experimentation we were able to draw such densely cusped sheet, but so high a ratio (approximately 2:1) of its mass was now in the cusps that little internodal material was left for draw. A reduced draw rate and a reduced temperature differential between hot sheet and needle array enabled us to improve the situation but the entire process now had to be carried slowly in controlled temperature conditions close to the melting point of the plastics. From this work we concluded that in practical terms good barbed fibres of balanced structural properties can be produced with deep barbs set closely together.

EXAMPLE 8

Cusps, and especially long cusps with aspect ratios >4, may be postworked before or after cold draw, without otherwise affecting the strength and uniformity of the fibre. In the materials described in Example 7 we were able to remove cusp tips or hot flatten cusp tips, heatseal cusp tips to the cusp tips of contiguous cusped sheet, and by controlled temperature softening and moulding we could curve or curl cusps creating hooked and other shapes. These operations did not alter the cold draw ability of the cusped film as a whole, provided that the operation was confined to the high angle region of cusps. Likewise we found that somewhat blunted pins would produce cusps blobby or flat at the tips, and whereas the consumption of more sheet mass in forming clumsy cusp tips did reduce the draw and materials distribution, useable products could be so made.

I claim:

1. A process of cold drawing a shaped plastic sheet wherein said sheet has a plurality of hollow pointed projections on one or both faces arranged in an array that forms parallel rows in at least one direction, said hollow pointed projections having at least a portion of the distal portion of the sides at an angle of over 60° to the median plane of the sheet which process comprises cold drawing the shaped plastic sheet by stretching the sheet along an axis in the median plane of the sheet and normal to a direction of parallel rows of projections, to thereby produce an oriented plastic sheet containing projections which remain incompletely drawn.

2. A process according to claim 1 wherein the hollow pointed projections are in the form of hollow cusps.

3. A process according to claim 2 wherein the distal portion of the sides of the hollow pointed projections are at an angle of over 70° to the median plane of the sheet.

4. A process according to claim 2 wherein the cusps are thin walled near the tip, relatively thick walled near the base of the cusp and the distal portion of the cusp has sides substantially normal to the plane of the sheet.

5. A process according to claim 2 wherein the shaped sheet consists of interconnecting cusps.

6. A process according to claim 1 wherein the shaped plastic sheet is stretched over 4 fold and under 16 fold.

7. A process according to claim 1 wherein the material of the plastic sheet is low density polyethylene, high density polyethylene, polyethylene terephthalate, nylon 6, nylon 66, nylon 610, or polypropylene.

* * * * *